United States Patent [19]

Kimbrough

[11] 4,216,910

[45] Aug. 12, 1980

[54] 360 DEGREE INTERNAL SPRAY CLEANING

[76] Inventor: Wade L. Kimbrough, P.O. Box 1467, Hobbs, N. Mex. 88240

[21] Appl. No.: 967,471

[22] Filed: Dec. 7, 1978

[51] Int. Cl.[2] ..... B05B 1/14; B05B 1/32

[52] U.S. Cl. ..... 239/456; 118/306; 118/DIG. 10; 134/167 C; 134/168 C; 239/554; 239/DIG. 13

[58] Field of Search ..... 239/455, 456, 457, 554, 239/561, DIG. 13; 134/167 C, 168 C, 22 C, 24; 118/306, 317, 408, DIG. 10

[56] References Cited

U.S. PATENT DOCUMENTS 2,539,344 1/1951 Carraway ..... 239/554

*Primary Examiner*—Robert W. Saifer
*Assistant Examiner*—Michael J. Forman
*Attorney, Agent, or Firm*—Wendell Coffee

[57] ABSTRACT

Pipes, coated with paraffin, scale or otherwise, are cleaned by internally spraying the pipe with a conic sheet of paraffin solvent or scale remover or other fluid. The reaction of the discharge of the sheet of fluid is the propelling force for advancing the nozzle through the opening. An axial jet of fluid clears the tube in front of the nozzle so that the nozzle can advance through the tube. The conic sheet is formed by a pair of sleeves around a mandrel, the sleeves meeting with correlative conic surfaces.

2 Claims, 5 Drawing Figures

Fig. 1
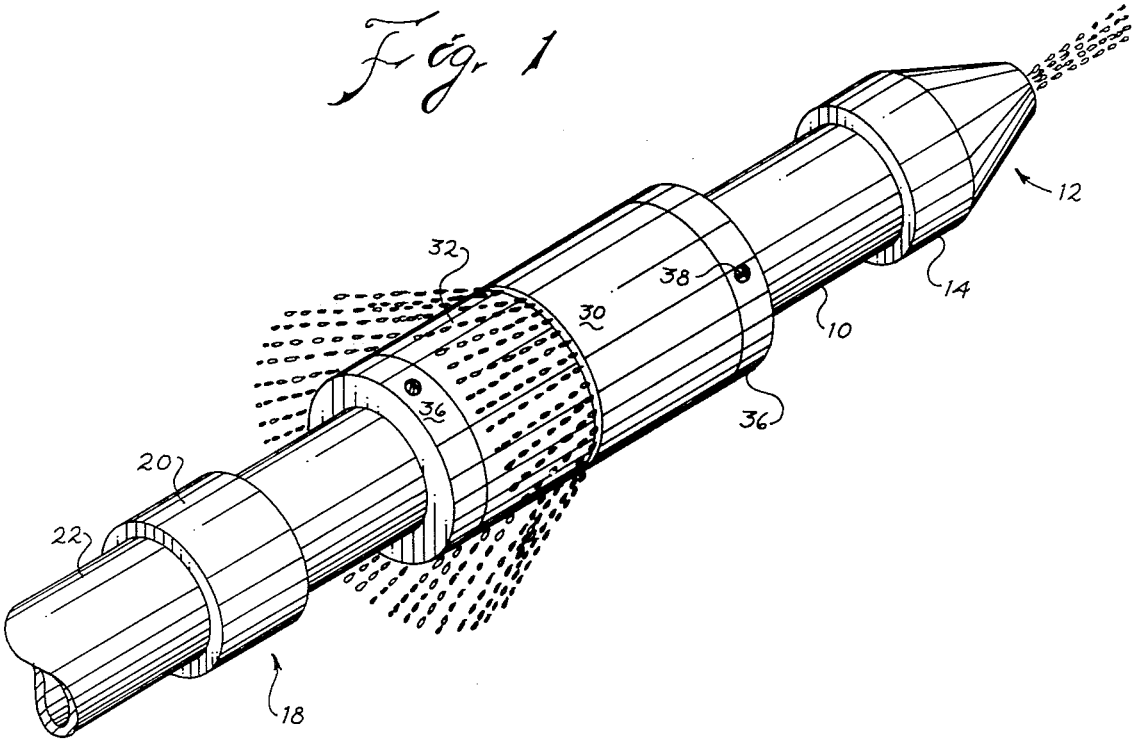
Fig. 2
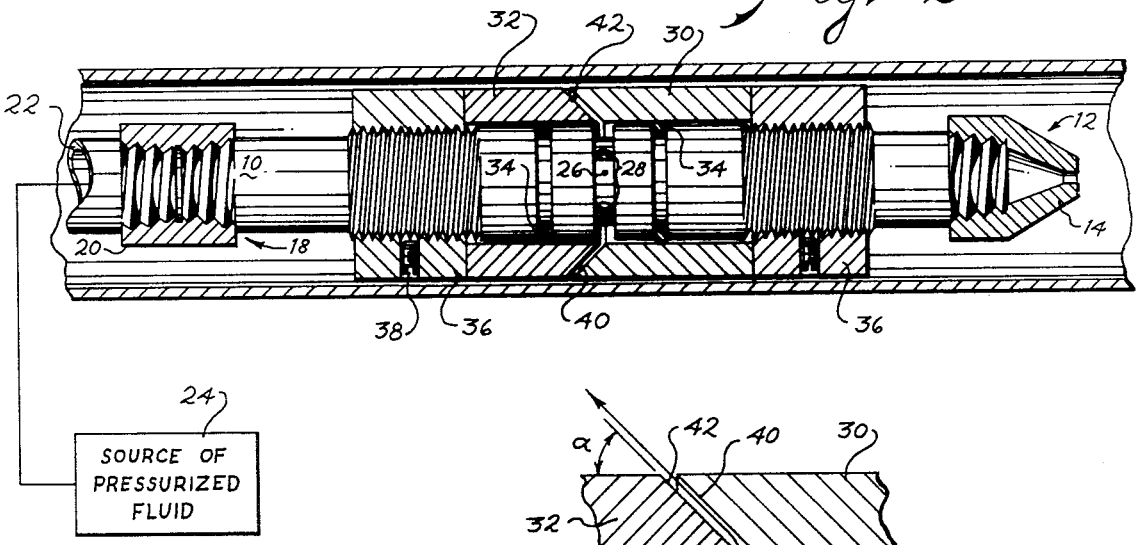
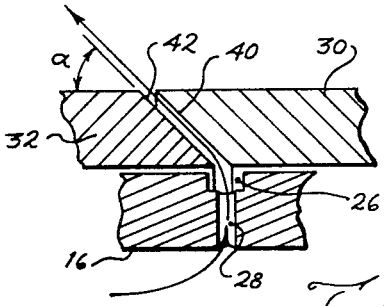
Fig. 3

360 DEGREE INTERNAL SPRAY CLEANING

BACKGROUND OF THE INVENTION (1) Field of the Invention

This invention relates to nozzles and more particularly to tube cleaners.

(2) Description of the Prior Art

Problems exists in the oil field and other industries with tubes becoming coated with paraffin and other buildups. According to the prior art, these are sometimes cleaned by putting a nozzle through the tube, the nozzle having a series of jets, each jet at an angle to the axis of the nozzle. The combination of the jets form something of a conic pattern, however, the fluid is sprayed in a series of individual jets instead of one solid 360° sheet. In use of this type of nozzle it is necessary to rotate the tube or the nozzle to prevent leaving a series of ridges along the pipe being cleaned.

The specific example of the problems inherent with cleaning paraffin tubes are in no way meant to indicate that there is not a general problem of cleaning the internal bores of tubes. Problems also exist in cleaning tubes and pipes of residues other than paraffin.

SUMMARY OF THE INVENTION (1) New and Different Function

I have invented a nozzle which produces a solid sheet discharge which can readily be adjusted to vary the volume or pressure or angle of the discharge. Two sleeves are placed on a mandrel. The mandrel has a groove with openings from its bore. The two sleeves have correlative conic surfaces which are placed on the mandrel with the joint between the sleeves at the groove. The sleeves are sealed to the mandrel. Collars on one side of the sleeves adjust the amount of opening or the space between the conic surfaces. The sleeves may be easily changed to change the angle.

I also provide an axial jet at the end of the nozzle to make sure that the opening through the pipe is great enough for the nozzle to advance through the pipe. The axial nozzle may be plugged if greater conic flow is desired.

In this way, I produce a nozzle having a continuous 360° sheet of fluid discharge circumferentially around the nozzle. Thus, it may be seen that the total function of my invention far exceeds the sum of the functions of the individual sleeves, seals, openings, etc. thereof.

(2) Objects of this Invention

An object of this invention is to clean the internal bores of tubes, pipes and other conduits.

Further objects are to achieve the above with a device that is sturdy, compact, durable, lightweight, simple, safe, efficient, versatile, ecologically compatible, energy conserving, and reliable, yet inexpensive and easy to manufacture, install, adjust, operate and maintain.

Other objects are to achieve the above with a method that is versatile, ecologically compatible, energy conserving, rapid, efficient, and inexpensive, and does not require skilled people to install, adjust, operate, and maintain.

The specific nature of the invention, as well as other objects, uses, and advantages thereof, will clearly appear from the following description and from the accompanying drawing, the different views of which are not necessarily scale drawings.

BRIEF DESCRIPTION OF THE DRAWINGS

FIG. 1 is a perspective view of an embodiment of my invention showing the fluid being discharged 360° therefrom.

FIG. 2 is an axial sectional view of a tube with the nozzle according to my invention therein.

FIG. 3 is an enlarged sectional view of the correlative conic surfaces of the sleeves on the mandrel.

DESCRIPTION OF THE PREFERRED EMBODIMENTS

First Embodiment

Figure 4:
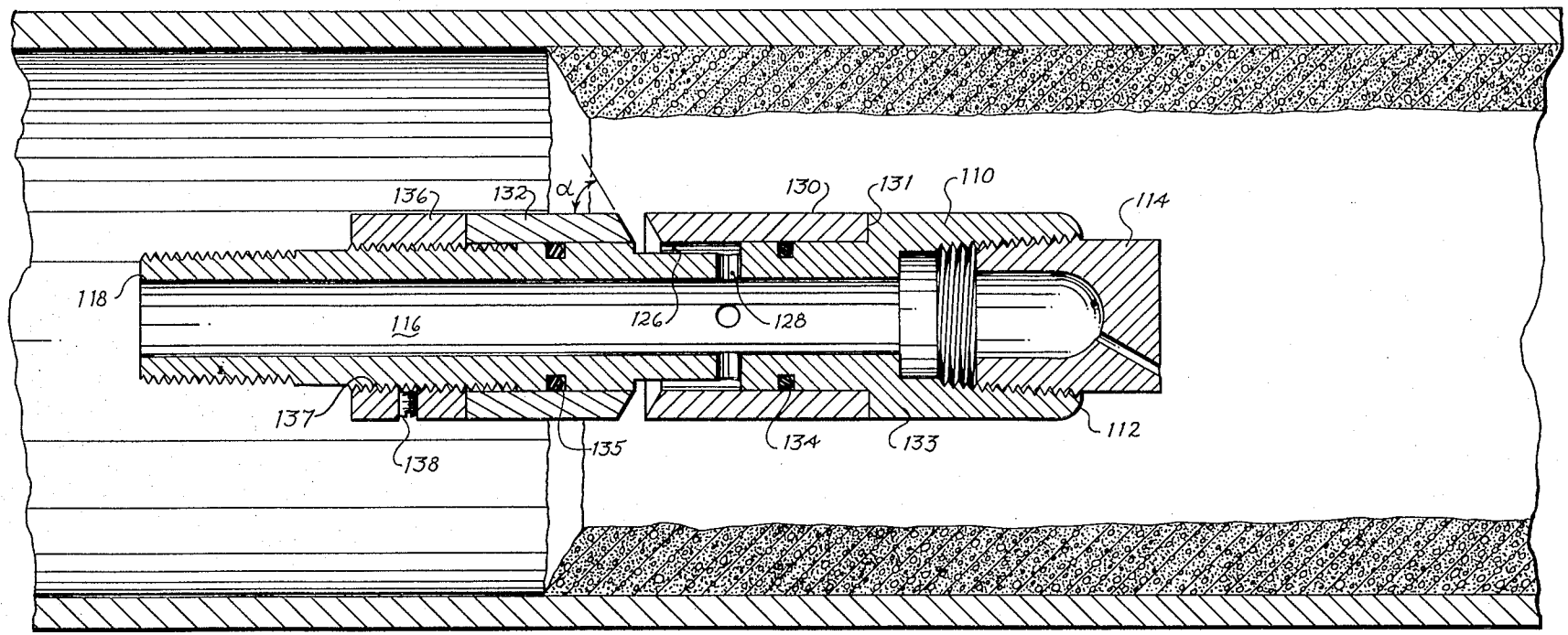
FIG. 4 is an axial section view of a second embodiment in a tube.

Referring to the drawing, it may be seen that a first embodiment of my invention is built upon mandrel 10, FIGS. 1, 2 and 3. The mandrel is threaded at each end.

One end is designated as a front end 12 which has an axial nozzle 14 connected thereto. The axial nozzle 14 is so called inasmuch as it has a single axial opening or multi orifice therethrough which will produce a jet of fluid aligned with the axis of the mandrel 10. It will be understood, that the mandrel 10 has an internal bore 16 therethrough.

The other end of the mandrel is designated as the supply end 18. Cuff 20 connects the supply end 18 to a supply hose 22. It is contemplated that normally the supply hose 22 would be flexible although it could be a rigid pipe. It is connected to a source of pressurized fluid 24. To effectively clean scale or cement from pipe a very high pressure of at least 10,000 psi and a minimum volume of 10 gallons per minute (40 liters per minute) is needed.

Still referring to the first embodiment, FIGS. 1, 2 and 3, about at the midpoint thereof, the mandrel 10 has an external circumferential groove 26 formed therein. A plurality of openings 28 connect the internal bore 16 of the mandrel 10 to the groove 26. Therefore, the openings 28 connect from the internal bore to outside the mandrel.

Two sleeves are telescoped over the mandrel. First sleeve 30 is telescoped over the mandrel on the front end of the mandrel, i.e., it extends from the circumferential groove 26 toward the axial nozzle 14. The second sleeve 32 extends to the supply end of the mandrel, i.e., it extends from the groove 26 toward the supply end 18. About midpoint of each sleeve, seal grooves are formed in the external portion of the mandrel to receive O-rings 34. Therefore, it may be seen that the O-rings form seals to fluidly seal each of the sleeves to the mandrel.

The O-rings, in their grooves, are spaced a convenient distance outboard from the circumferential groove 26. They would normally not be greater distance from the circumferential groove than half the length of the sleeves.

FIG. 2, outboard of each sleeve, locating nuts 36 are threaded to the mandrel. By outboard, I mean that one nut 36 is located at the front end of the first sleeve 30 and another locating nut is located at the supply end of second sleeve 32. The nuts are threaded to external threads on the mandrel and are held in their position by set screw 38. The nuts form location means on the mandrel for locating each sleeve to the mandrel.

For purposes of manufacture and assembly it will be noted that the mandrel has a maximum diameter at the sleeve portion and that the threads receiving the locating nuts are in the portion of the mandrel having the greatest diameter. At the termination of the nuts, the mandrel diameter is no greater than the root diameter of the threads receiving the nuts 36.

I have found that it is preferable to have a one half inch clearance between the sprayer and the wall of the pipe being cleaned. I.e., a two inch pipe would be most efficiently cleaned using a sprayer of no more than one inch diameter. FIG. 2, of the drawing, being for illustrative purposes only does not show this relationship.

The sleeves 30 and 32 have correlative conic surfaces 40 and 42 at the groove 26. The distance between the conic surfaces will depend upon the location of the nut 36. They will be spaced apart but only very slightly so. Those skilled in the art will understand that any liquid at 10,000 lbs. pressure will flow through a very small opening. Therefore the space between the two sleeves will be very small.

The conic surfaces will be correlative to one another, i.e., they will both have the same conic angle alpha. This conic angle is not particularly critical, however, results in ease of manufacture and standardization, certain angles will be standard.

Also, it will be noted that the conic angle or the cone formed by the surfaces will such that the 360° conic sheet of fluid as discharged from the nozzle will be pointing rearward. I.e., the apex of the cone will be toward the front end of the mandrel. Therefore, it may be seen that in use of the nozzle that the discharge of the conic sheet of fluid will tend to pull the nozzle through the tube. Of course, this force pulling the nozzle through the tube will be counteracted by the discharge of the axial jet from the axial nozzle 14. However, assuming that there is much more fluid being discharged by the conic sheet than is discharged by the axial jet that the resultant force will be a forward force tending to pull the nozzle through the tube.

SECOND EMBODIMENT

FIG. 4 illustrates a second embodiment of the invention. The mandrel 110 has a front end 112. In this case, the front end has internal threads and axial nozzle 114 is threaded therein. The axial nozzle, instead of having a single jet, has a plurality of jets diverging outward slightly, however, it is still referred to as an axial jet.

Figure 5:
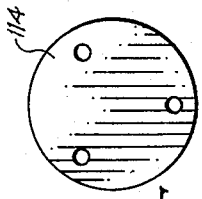
FIG. 5 is a front view of the nozzle of FIG. 4.

FIG. 5 shows a front view of the axial nozzle 114 with three diverging openings. It will be readily understood by those skilled in the art, that if the pipe, conduit or other tube being cleaned was open all the way through to receive the nozzle that a solid plug could be inserted into the internal threads of the front end 112. Further different configurations of openings for different applications would be in order.

The mandrel 110 has internal bore 116 with a supply end 118 which has standard pipe threads for the connection of a supply. Groove 126 extends over a extended length measured lengthwise along the nozzle. Openings 128 open at the forward end of the elongated groove 126. The first sleeve or forward sleeve 130 abuts against shoulder 131 formed by forward flange 133 (as shown). The first sleeve 130 extends back to near the rear end of elongated groove 126. The first sleeve has a rearward opening conic surface which angles backwards.

As may be seen in FIG. 4, the correlative conic surfaces of the two sleeves have a conic angle alpha. Therefore, the spray more nearly sprays diametrically outward than the first embodiment shown in FIG. 2. For removing certain buildups within the pipe, such as scale, I have found it desirable to have a larger conic angle, i.e., the spray is spraying more clearly circumferentially outward than angled back. Not only are scales removed with such a spray but also in certain cases, the pipe which has been intentionally cement lined, the cement lining can be removed with such a spray. The first sleeve 130 is sealed to the mandrel by O-ring 134 between the front of the groove 126 and the shoulder 131 of the flange 133.

The second sleeve 132 has a correlative conic angle in the forward portion of it and is adjacent to the conic surface on the sleeve 130. These conic surfaces are adjacent to the rear portion of the groove 126. The second sleeve is sealed to the mandrel by O-ring 135 located between the rear of the groove 126 and threads 137. The single locating nut 136 is threaded to the threads 137 and held in place by the set screw 138. By using only one nut, not only is the manufacture of the nozzle easier and less expensive but also when it is being adjusted there is only one adjustment to make. Also, by having the groove 126 elongated, there is a better and more even flow of liquid from the correlative conic surfaces between the sleeves. I have found, in certain cases, where the conic surfaces are immediately above the opening 128, as seen in FIG. 1, there will be a greater flow immediately above the openings 128 than angularly spaced from the openings 128. Therefore, I have found it desirable to space the conic surfaces at a slight distance from the openings 128.

Also, it will be understood to those skilled in the art that for any particular operation a different conic angle alpha can be obtained by quickly removing the sleeves and telescoping sleeves having the desired conic angle alpha around the mandrel. The angle can be changed very quickly. Those skilled in the art will also recognize that a tool of this nature is useful in cleaning sewers.

When I speak of a 360° spray, obviously, I am speaking that this spray is evenly spread around the axis of the nozzle and that it is a continuous spray of 360° throughout the entire 360° circle rather than being only in certain areas thereof as it would be, e.g., if there were four rearwardly pointing nozzles.

As an aid to correlating the terms of the claims to the exemplary drawing, the following catalog of elements is provided:

| | |
|---|---|
| 10 mandrel | 110 mandrel |
| 12 front end | 112 front end |
| 14 axial nozzle | 114 axial nozzle |
| 16 internal bore | 116 internal bore |
| 18 supply end | 118 supply end |
| 20 cuff | 126 groove |
| 22 supply pipe | 128 openings |
| 24 source of fluid | 130 first sleeve |
| 26 groove | 131 shoulder |
| 28 openings | 132 second sleeve |
| 30 first sleeve | 133 flange |
| 32 second sleeve | 134 O-rings |
| 34 O-rings | 135 O-ring |
| 36 locating nut | 136 locating nut |
| 38 set screw | 137 threads |
| 40 surfaces | 138 set screw |
| 42 surfaces | |

The embodiments shown and described above are only exemplary. I do not claim to have inverted all the parts, elements or steps described. Various modifications can be made in the construction, material, arrangement, and operation, and still be within the scope of my invention. The limits of the invention and the bounds of the patent protection are measured by and defined in the following claims. The restrictive description and drawing of the specific examples above do not point out what an infringement of this patent would be, but are to enable the reader to make and use the invention.

I claim as my invention:

1. An internal spray nozzle comprising:

a. a mandrel having b. a threaded supply end to connect the mandrel to a source of pressurized fluid, c. an axial bore therethrough, d. an elongated external circumferential groove on the mandrel, e. a plurality of openings from the bore to the groove, f. a first sleeve and g. a second sleeve telescoped on the mandrel, h. said sleeves having a correlative conic surface adjacent each other and located over and in fluid communication with the groove, j. said conic surfaces over one end of the elongated groove and the openings at the other end thereof, k. a circumferential O-ring seal between each sleeve and said mandrel, m. said O-ring in a seal groove in the mandrel, and n. locating means on the mandrel for locating both of said sleeves to the mandrel, o. at least one of said locating means being in the form of a nutthreaded to said mandrel with p. a set screw in said nut to lock said nut to the mandrel.

2. The invention as defined in claim 1 further comprising:

q. a nozzle at the end of the mandrel opposite the supply end axially aligned therewith.

* * * * *